US011015860B1

(12) United States Patent
Bassani et al.

(10) Patent No.: US 11,015,860 B1
(45) Date of Patent: May 25, 2021

(54) DOOR BINS AND DOOR LINER INTERFACE

(71) Applicant: Electrolux Home Products, Inc., Charlotte, NC (US)

(72) Inventors: Bruno Rodrigues Bassani, Anderson, SC (US); Cristhian Camilo Serrano Camacho, Charlotte, NC (US); Carlos Cordero, Anderson, SC (US)

(73) Assignee: Electrolux Home Products, Inc., Charlotte, NC (US)

( * ) Notice: Subject to any disclaimer, the term of this patent is extended or adjusted under 35 U.S.C. 154(b) by 0 days.

(21) Appl. No.: 16/718,576

(22) Filed: Dec. 18, 2019

(51) Int. Cl.

| | |
|---|---|
| ***F25D 23/04*** | (2006.01) |
| ***F25D 25/02*** | (2006.01) |
| ***F25D 23/02*** | (2006.01) |
| ***F25D 23/06*** | (2006.01) |

(52) U.S. Cl.
CPC ..... *F25D 23/04* (2013.01); *F25D 23/028* (2013.01); *F25D 23/066* (2013.01); *F25D 25/02* (2013.01)

(58) Field of Classification Search
CPC ..... F25D 23/025; F25D 23/028; F25D 23/04; F25D 23/066; F25D 23/067; F25D 25/02; F25D 2325/00
See application file for complete search history.

(56) References Cited

U.S. PATENT DOCUMENTS

| | | | | |
|---|---|---|---|---|
| 5,322,366 | A | 6/1994 | Revlett et al. | |
| 5,445,452 | A * | 8/1995 | Kauffman | F25D 23/04 312/321.5 |
| 6,231,146 | B1 * | 5/2001 | Dang | F25D 23/04 312/321.5 |
| 6,997,526 | B2 | 2/2006 | Leimkuehler et al. | |
| 8,052,236 | B2 | 11/2011 | Kim | |
| 8,220,886 | B2 * | 7/2012 | Han | F25D 23/067 312/402 |
| 8,439,462 | B2 | 5/2013 | Seo et al. | |
| 9,389,012 | B2 | 7/2016 | Rackley et al. | |
| 9,500,403 | B2 * | 11/2016 | Seo | F25D 23/04 |
| 9,572,428 | B2 | 2/2017 | Seeley | |
| 9,657,984 | B2 | 5/2017 | Wang et al. | |
| 9,702,614 | B2 | 7/2017 | Lim | |
| 9,752,821 | B2 | 9/2017 | Seeley | |
| 9,803,913 | B2 | 10/2017 | Burke et al. | |

(Continued)

FOREIGN PATENT DOCUMENTS

| | | | | |
|---|---|---|---|---|
| CN | 104406356 A | * | 3/2015 | F25D 23/02 |
| JP | 2008292092 A | * | 12/2008 | F25D 23/04 |

(Continued)

*Primary Examiner* — Andrew M Roersma
(74) *Attorney, Agent, or Firm* — Pearne & Gordon LLP

(57) ABSTRACT

A door for closing a compartment of a cooled kitchen appliance having a door liner and a storage bin mounted to the door liner. The door liner comprises a first side configured to face the compartment that the door closes, walls protruding from the first side of the liner, and a ledge also protruding from the first side of the liner. The storage bin comprises walls which, together with the walls and ledge of the liner, define a storage space that can store items. The storage bin and door liner can comprise mating lug features that allow the storage bin to be mounted to the door liner. In one example, the storage bin can comprise an isolated sub-section defining an isolated storage space separate from the rest of the storage space of the storage bin.

16 Claims, 10 Drawing Sheets

(56) References Cited

U.S. PATENT DOCUMENTS

| | | | |
|---|---|---|---|
| 9,874,393 | B2 | 1/2018 | Rackley et al. |
| 9,976,793 | B2 | 5/2018 | Eom et al. |
| 10,168,093 | B2 | 1/2019 | Eom et al. |
| 10,240,854 | B2 | 3/2019 | Jung et al. |
| 10,451,338 | B2 | 10/2019 | Cordero et al. |
| 2017/0108265 | A1 | 4/2017 | Wang et al. |
| 2017/0328627 | A1 | 11/2017 | Park et al. |
| 2019/0041121 | A1 | 2/2019 | Bento et al. |
| 2019/0041122 | A1 | 2/2019 | Bento et al. |

FOREIGN PATENT DOCUMENTS

| | | | | | |
|---|---|---|---|---|---|
| KR | 20060027469 | A * | 3/2006 | | |
| KR | 20080040192 | A * | 5/2008 | ..... | F25D 23/04 |
| KR | 20130094009 | A * | 8/2013 | ..... | F25D 23/04 |
| KR | 20180060653 | A * | 6/2018 | | |
| WO | 2007033951 | | 3/2007 | | |
| WO | 2008080919 | | 7/2008 | | |
| WO | 20110057961 | | 5/2011 | | |
| WO | 2015107118 | | 7/2015 | | |
| WO | WO-2018116379 | A1 * | 6/2018 | ..... | F25D 23/04 |

* cited by examiner

DOOR BINS AND DOOR LINER INTERFACE

TECHNICAL FIELD

This disclosure relates generally to door bins to be mounted to door for a fresh food or freezer compartment of a kitchen appliance, and to a door liner for the door having features to support and mount the door bins.

BACKGROUND

Cooled kitchen appliances such as refrigerators and freezers often include door bins for increasing the storage capacity inside the appliance. Existing door bins, however, involve complex mounting arrangements and/or can be undesirably disconnected from the door when excessive force is applied to the door bin, either from the items stored therein or from outside forces such as a user pushing on the door bin. It is desirable to have a door bin having a simple mounting arrangement that is designed to withstand excessive forces that it may encounter.

SUMMARY

The following presents a simplified summary of the disclosure in order to provide a basic understanding of some example aspects described in the detailed description.

A door for closing a compartment of a cooled kitchen appliance having a door liner and a storage bin mounted to the door liner. The door liner includes a first side configured to face the compartment that the door closes, walls protruding from the first side of the liner, and a ledge also protruding from the first side of the liner. The storage bin includes walls which, at the assembled state together with the walls and ledge of the liner, define a storage space that can store items.

The ledge can form a portion of a bottom surface of the storage bin that defines the storage space. A bottom wall of the storage bin can also form a part of the bottom surface. The ledge can have a recessed portion that the bottom wall of the storage bin rests on. Additionally, the bottom wall of the storage bin can itself have a recessed portion that receives the non-recessed portion of the ledge.

The walls of the door liner can include side walls to which the storage bin is mounted. The side walls of the door liner can include lugs defining a receiving space and the walls of the storage bin can include side walls themselves having a lug, wherein the lugs of the storage bin side walls are received within the receiving space between the door liner lugs. The lugs of the side walls of the door can include a side wall lug projected inwards from an inner face of the side walls and a corner lug projected inwards at a corner where the inner face of the side walls meets a rear wall of the door liner. The lugs of the storage bin side walls can be flexible in a direction towards the lugs of the door liner when received within the receiving space therebetween such that each lug of the storage bin is secured between the lugs of the door liner. The lugs of the storage bin can include two vertically-extending walls projected outwardly from the side walls of the storage bin and a plurality of horizontally-extending wall projected outwardly from the side walls of the storage bin and extending between the vertically-extending walls. Each lug of the storage bin can extend outwardly from a recessed portion of the side walls. Each lug extending from the recessed portions defines a first receiving space for receiving the side wall lugs and a second receiving space for receiving the corner lugs. The rear wall of the door liner can further include a lug adjacent each corner lug defining a receiving space therebetween. A rear edge of the side walls of the storage bin can be received within the receiving space defined between each rear lug and each corner lug when the storage bin is mounted to the door liner.

The storage bin can further include a hook extending from the lower side of a bottom front wall thereof and the ledge of the door liner can include a receiving space, wherein the hook is received within the receiving space.

The storage bin can include an isolated sub-section defining an isolated storage space separate from the rest of the storage space of the storage bin. The isolated sub-section can include a rotatable lid enclosing said isolated storage space.

DETAIL DESCRIPTION OF EXAMPLE EMBODIMENTS

Figure 1:
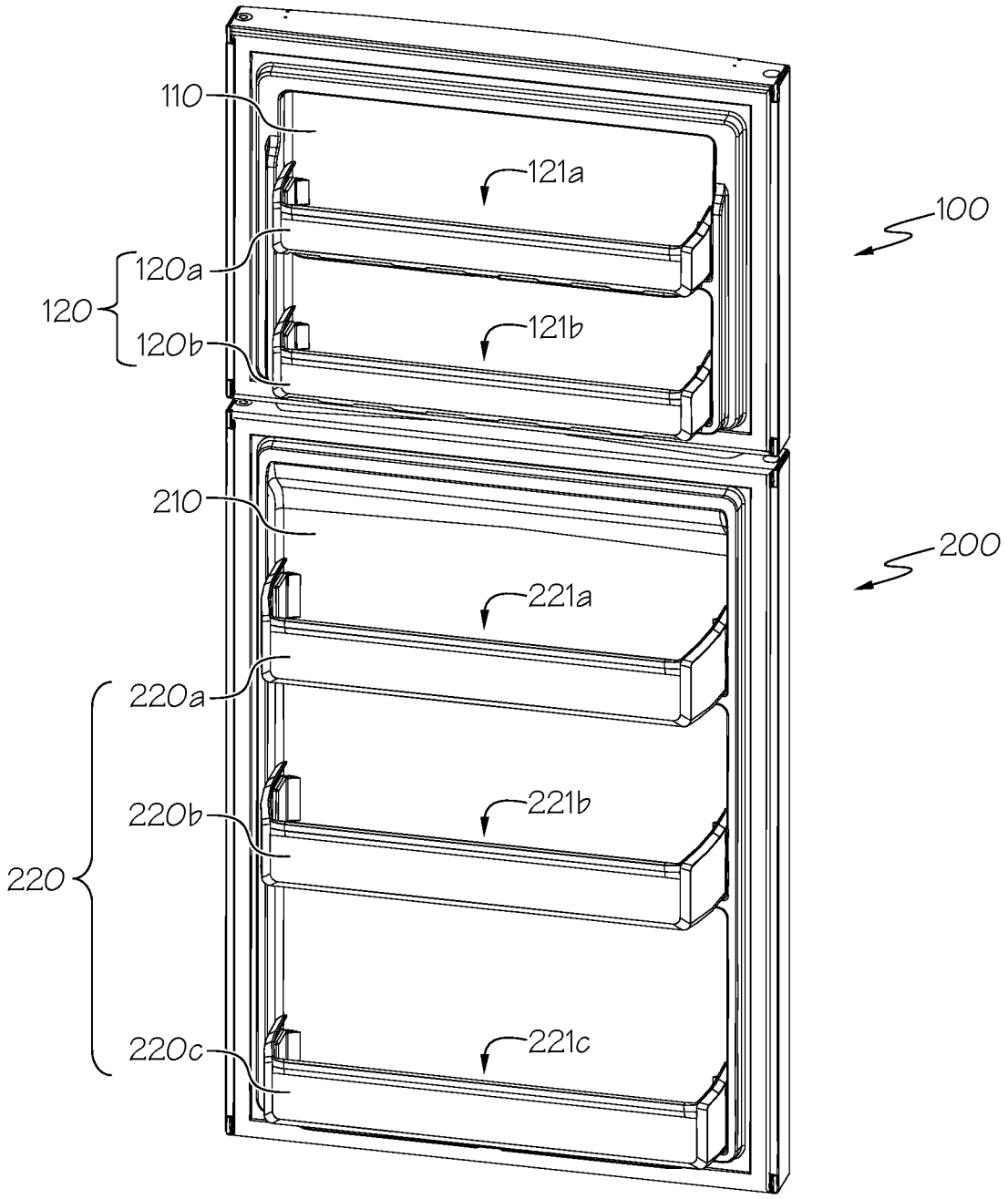
FIG. 1 is a rear view of an example freezer door and a corresponding example fresh food door for a cooled kitchen appliance each supporting door bins thereon.

FIG. 1 shows a freezer door 100 and a fresh food door 200 for a cooled kitchen appliance that restrict and grant access to a corresponding freezer compartment (not shown) and a fresh food compartment (not shown). Although the detailed description that follows concerns a domestic refrigerator, the invention can be embodied by refrigeration appliances other than a domestic refrigerator. The refrigerator houses a fresh-food compartment, a freezer compartment, and/or optionally a variable temperature compartment. Although the illustrated refrigerator is described with reference to a top-mount refrigerator (i.e., fresh food compartment disposed vertically below the freezer compartment), it is to be understood that other configurations are contemplated, for example, a side by side refrigerator (i.e., fresh food compartment disposed laterally adjacent the freezer compartment), a bottom mount or French-door refrigerator (i.e., fresh food compartment disposed vertically above the freezer compartment) etc.

The fresh food compartment serves to minimize spoiling of articles of food stored therein. The fresh food compartment accomplishes this by maintaining the temperature in the fresh food compartment at a cool temperature that is typically above 0° C., so as not to freeze the articles of food in the fresh food compartment. It is contemplated that the cool temperature preferably is between 0° C. and 10° C., more preferably between 0° C. and 5° C. and even more preferably between 0.25° C. and 4.5° C.

The freezer compartment is used to freeze and/or maintain articles of food stored therein in a frozen condition. For this purpose, the freezer compartment is in thermal communication with a freezer evaporator (not shown) that removes thermal energy from the freezer compartment to maintain the temperature therein at a temperature of 0° C. or less during operation of the refrigerator, preferably between 0° C. and −50° C., more preferably between 0° C. and −30° C. and even more preferably between 0° C. and −20° C.

Figure 2:
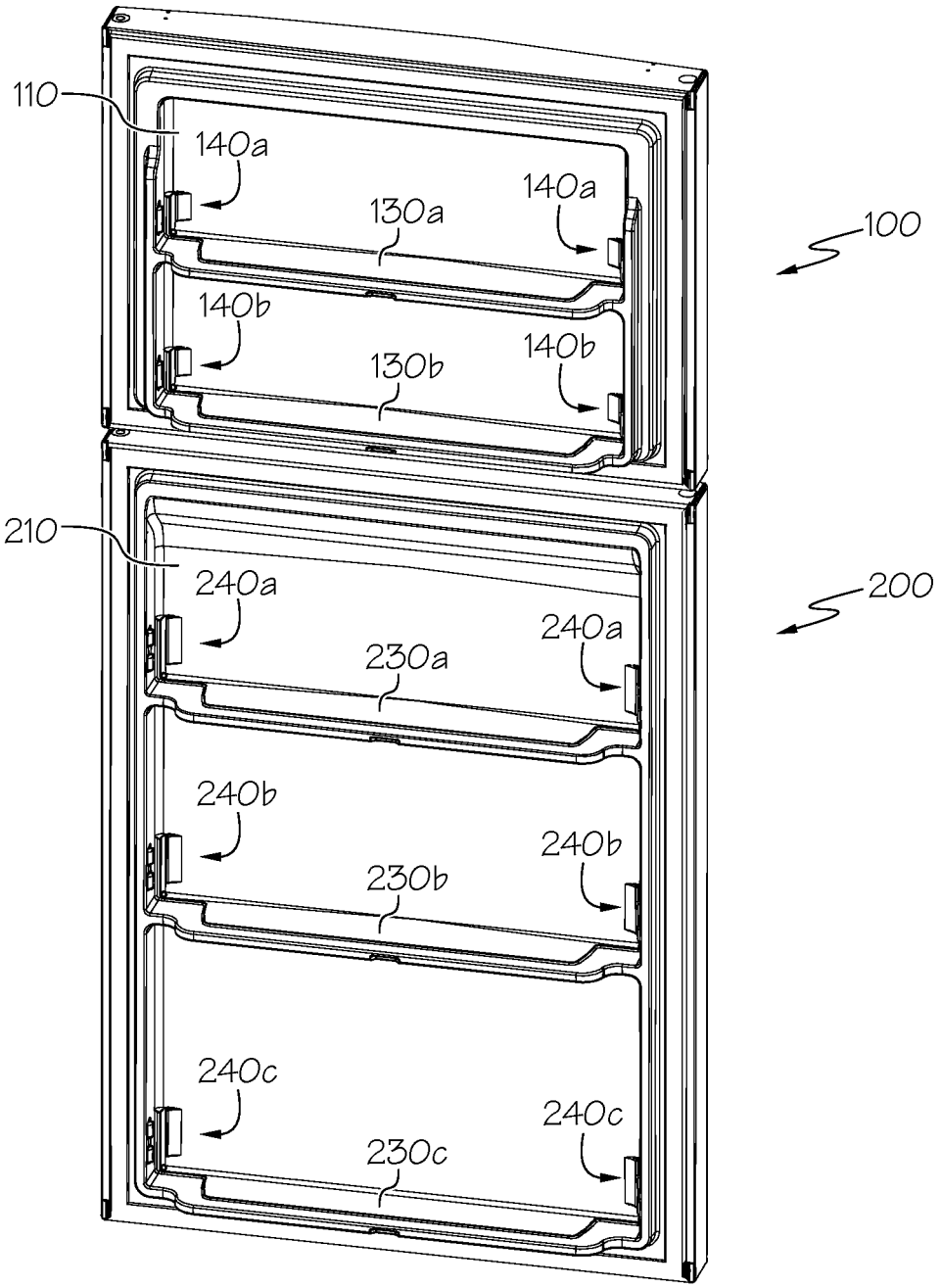
FIG. 2 is a rear view of the freezer door and fresh food door of FIG. 1 with the door bins removed.

Referring now to FIGS. 1 and 2, the freezer door 100 includes an outer skin forming a front wall and optionally side walls of the door, and a pair of end caps forming the top and bottom walls of the door. The outer skin and end caps can be made of a structurally rigid material, such as metal or plastic. A liner 110 is configured to face the freezer compartment when the door is closed, as is generally known in the art. The liner 110 is coupled to each of the side walls of the door and also to the top and bottom end caps, forming a hollow interior door cavity that is filled with a rigid, expanding foam that provides thermal insulation. Similarly, the fresh food door 200 includes a similar construction with a liner 210 configured to face the fresh food compartment when the door is closed, as is also generally known in the art. Attached to the liners 110, 210 are storage bins 120, 220 designed to provide additional storage space for the freezer and fresh food compartments, respectively. In one example, attached to the freezer door liner 110 is a first, upper storage bin 120*a* defining a storage space 121*a* along with the liner 110, and a second, lower storage bin 120*b* defining a storage space 121*b* along with the liner 110. Similarly, attached to the fresh food door liner 210 is a first, upper storage bin 220*a* defining a storage space 221*a* along with the liner 210, a second, middle storage bin 220*b* defining a storage space 221*b* along with the liner 210, and a third, lower storage bin 220*c* defining a storage space 221*c* along with the liner 210. The various storage bins can be similar or even identical, and/or can differ in various says. In one example the storage bins for the fresh food compartment may be relatively taller since there is more vertical space on the fresh food door.

FIG. 2 shows the freezer door 100 and the fresh food door 200 with the storage bins 120, 220 removed. With the storage bins 120 removed, a first, upper ledge 130*a* and a second, lower ledge 130*b* extending out from and across the width of the liner 110. Both of the first, upper ledge 130*a* and a second, lower ledge 130*b* can be formed together with the freezer liner 110 (i.e., monolithic), although it is contemplated that any of the ledges could be separately attached. Similarly, a first, upper pair of liner lug assemblies 140*a* and a second, lower pair of liner lug assemblies 140*b* for supporting the storage bins 120*a*, 120*b*, respectively, can be associated with each of the upper and lower ledges 130*a*, 130*b*. Turning now to the fresh food door, with the storage bins 220 removed a first, upper ledge 230*a*, a second, middle ledge 230*b*, and a third, lower ledge 230*c* extending out from and across the width of the liner 210 extend out from and across the width of the liner 210. Similarly, a first, upper pair of liner lug assemblies 240*a*, a second, middle pair of liner lug assemblies 240*b* and a third, lower pair of liner lug assemblies 240*c* for supporting the storage bins 220*a*, 220*b*, 220*c*, respectively, can be associated with each of the ledges 230*a*, 230*b*, 230*c*. The first, upper ledge 230*a*, a second, middle ledge 230*b*, and a third, lower ledge 230*c* can be formed together with the fresh food liner 210 (i.e., monolithic), although it is contemplated that any of the ledges could be separately attached.

Figure 3:
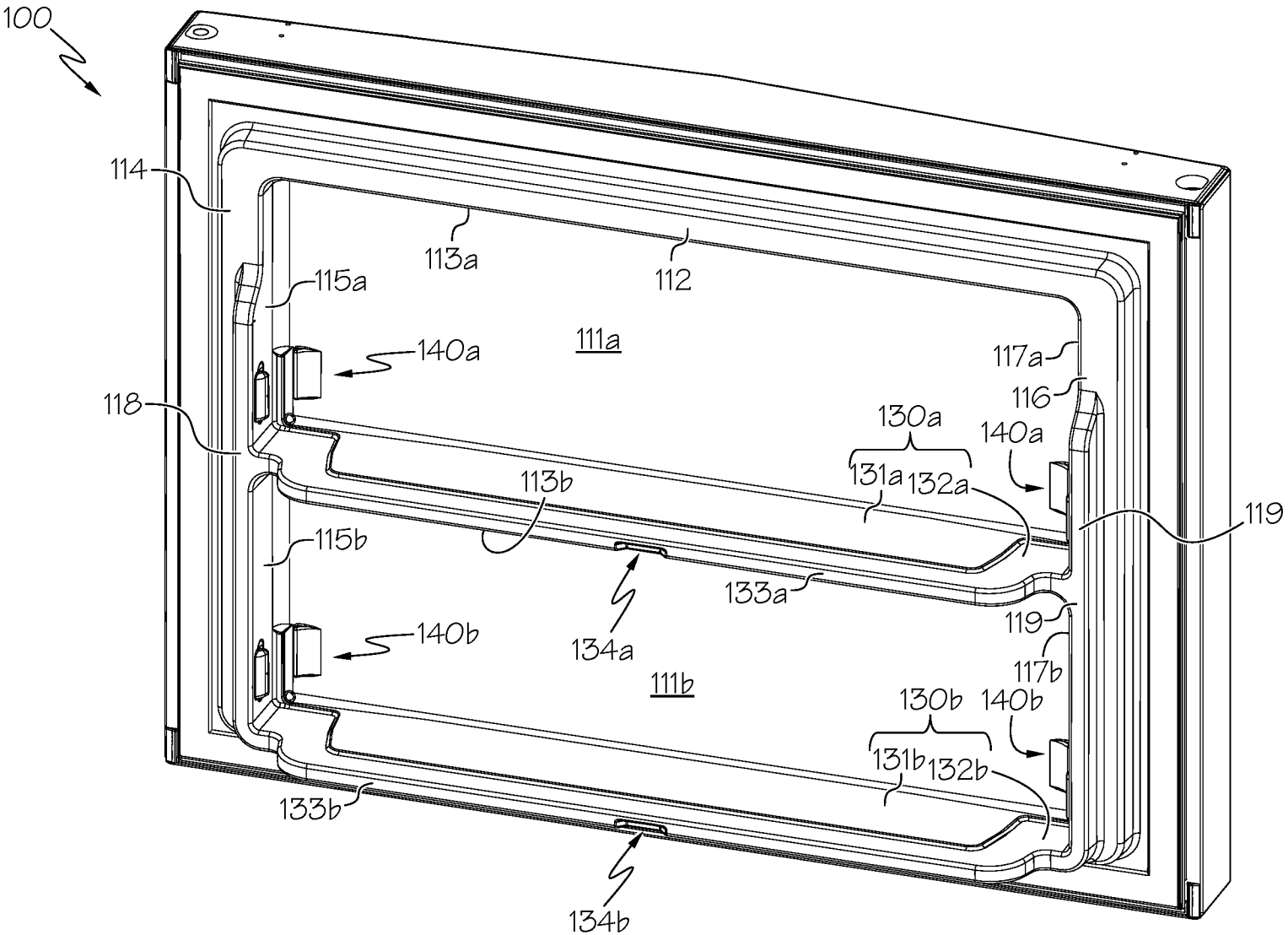
FIG. 3 is an enlarged rear view of the freezer door of FIG. 2.

Turning to FIG. 3, an enlarged view of the freezer door 100 is shown. Attachment features for securing the door bins to the door liners will now be described with reference to the freezer door, with the understanding that similar or even identical features can be used with the door bins and liner of the fresh food door. In FIG. 3, it is illustrated that the liner 110 includes a top wall 112, a left side wall 114, and a right side wall 116. These walls 112, 114, 116 are projected from the base of the liner to create a top inner face 113*a*, and left inner face 115*a*, 115*b* (including inner face upper portion 115*a* and inner face lower portion 115*b*), and a right inner face 117*a*, 117*b* (including inner face upper portion 117*a* and inner face lower portion 117*b*). The left side wall 114 includes a projected portion 118 and the right side wall 116 includes a projected portion 119. These projected portions 118, 119 increased the width of the left inner face 115*a*, 115*b* and right inner face 117*a*, 117*b*, respectively to enable a deeper door bin to be utilized.

An upper rear wall 111*a* is bounded by the first, upper ledge 130*a*, the top wall 112, left side wall 114, and right side wall 114, and adjacent to the top inner face 113*a*, the upper portion of the left inner face 115*a*, and the upper portion of the right inner face 117*a*. When the first, upper storage bin 120*a* is mounted to the liner 110, the rear wall 111*a* serves as the back edge of the storage space 121*a*. The first, upper ledge 130*a* includes a raised surface portion 131*a* and a recessed surface portion 132*a*, as discussed in more detail below. The front edge 133*a* of the ledge 130*a* includes a receiving slot 134*a*, as discussed in more detail below. Portions of each of the liner lug assemblies 140*a* project from the rear wall 111*a*, and portions also project from the upper portion of the left inner face 115*a* and the upper portion of the right inner face 117*a*, respectively.

Similarly, a lower rear wall 111*b* is bounded by the first, upper ledge 130*a*, the second, lower ledge 130*b*, left side wall 114, and right side wall 114, and adjacent under side 113*b* of the ledge 130*b*, the lower portion of the left inner face 115*b*, and the lower portion of the right inner face 117*b*. When the second, lower storage bin 120*b* is mounted to the liner 110, the rear wall 111*b* serves as the back edge of the storage space 121*b*. The second, lower ledge 130*b* includes a raised surface portion 131*b* and a recessed surface portion 132*b*, as discussed in more detail below. The front edge 133*b* of the ledge 130*b* includes a receiving slot 134*b*, as discussed in more detail below. Portions of each of the liner lug assemblies 140*b* project from the rear wall 111*b*, and portions also project from the lower portion of the left inner face 115*b* and the lower portion of the right inner face 117*b*, respectively. While an enlarged view of the fresh food door 200 is not shown in the manner of the freezer door shown in FIG. 3, it is to be appreciated that the fresh food door 200 has similar features, as can be seen in FIGS. 1-2, but are numbered therein with 200-series reference numbers.

Figure 4:
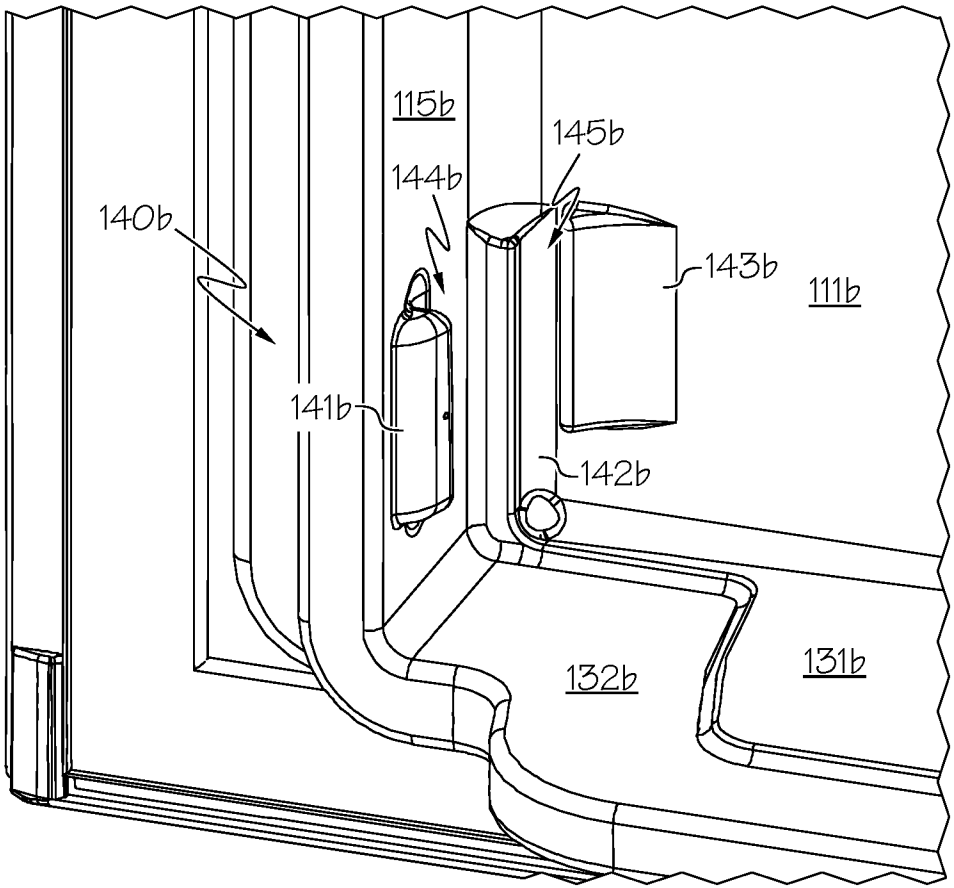
FIG. 4 is an enlarged rear detail view of a portion of the freezer door of FIG. 3 depicting a door liner lug assembly.

Turning to FIG. 4, an enlarged detail view of a portion of the liner 110 is shown, including the left liner lug assembly 140*b*. This liner lug assembly 140*b* includes: a side wall lug 141*b* projected from the lower portion of the left inner face 115*b*; a corner lug 142*b* projected at the corner interface of the lower portion of the left inner face 115*b* and the rear wall 111*b*; and a rear wall lug 143*b* projected from the rear wall 111*b*. Defined in a gap space between the side wall lug 141*b* and the corner lug 142*b* is a side wall receiving space 144*b*. Similarly, defined in another gap space between the corner lug 142*b* and the rear wall lug 143*b* is a rear wall receiving space 145*b*. The receiving spaces 144*b*, 145*b* are discussed in further detail below.

Figure 5:
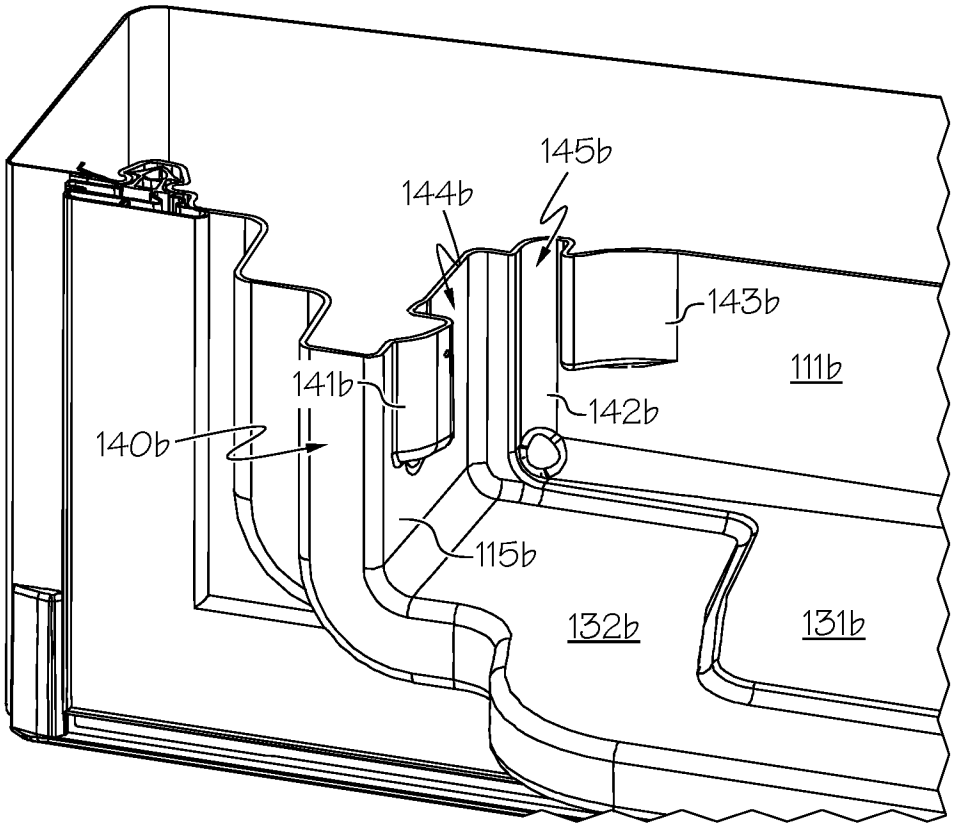
FIG. 5 is a partial sectional view of the portion of the freezer door of FIG. 4.

FIG. 5 depicts a similar view to that of FIG. 4, with a detail cutaway cross-section that extends through the lugs 141*b*, 142*b*, 143*b* and receiving spaces 144*b*, 145*b* so as to further illustrate one example shape and configuration of these components. It is to be appreciated that all the liner lug assemblies described herein can have similar features to those depicted in FIGS. 4-5, although some or all could have different features and/or shapes.

Figure 6:
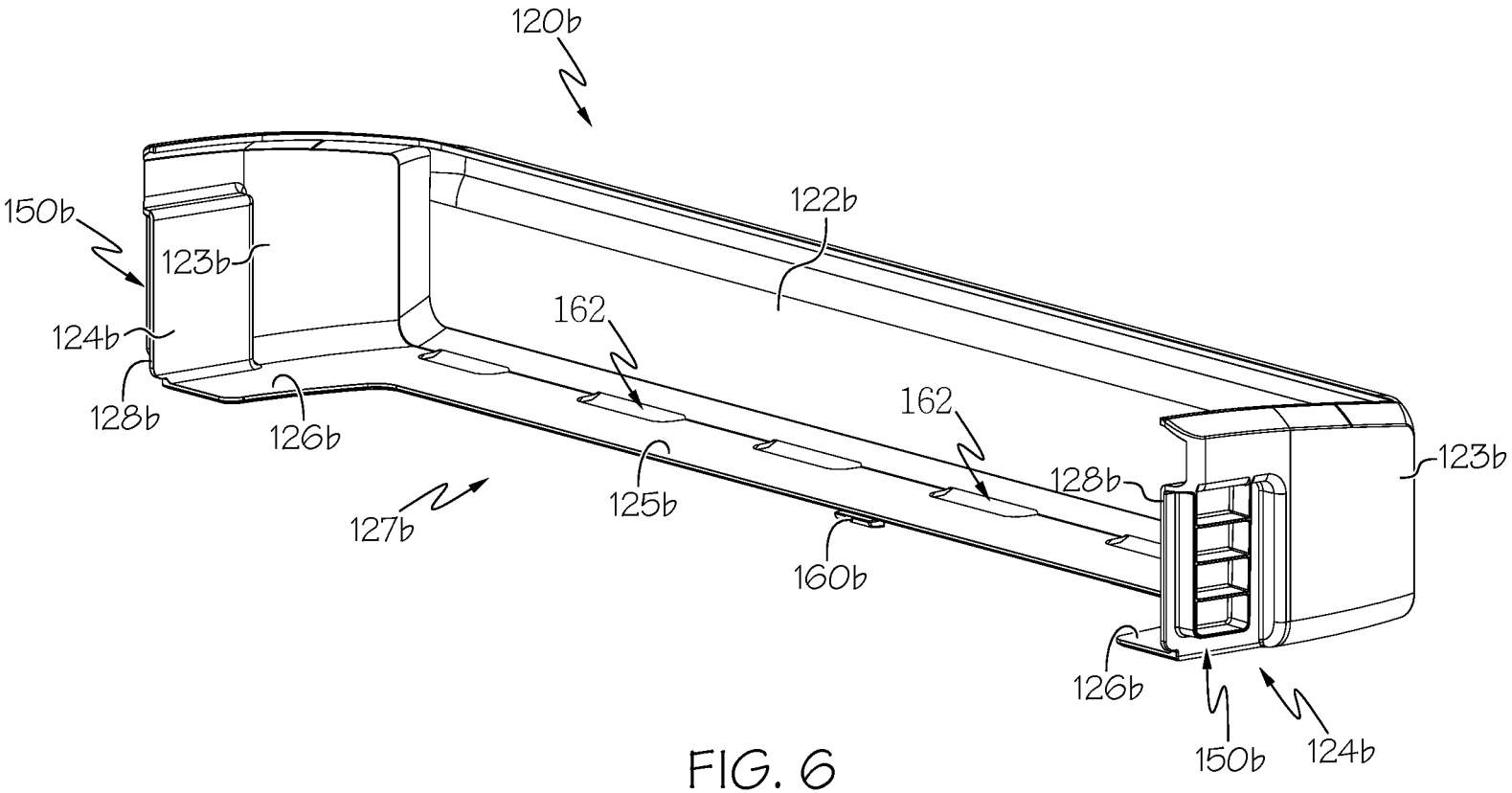
FIG. 6 is a rear perspective view of a door bin as shown in FIG. 1, separated from the doors.
Figure 7:
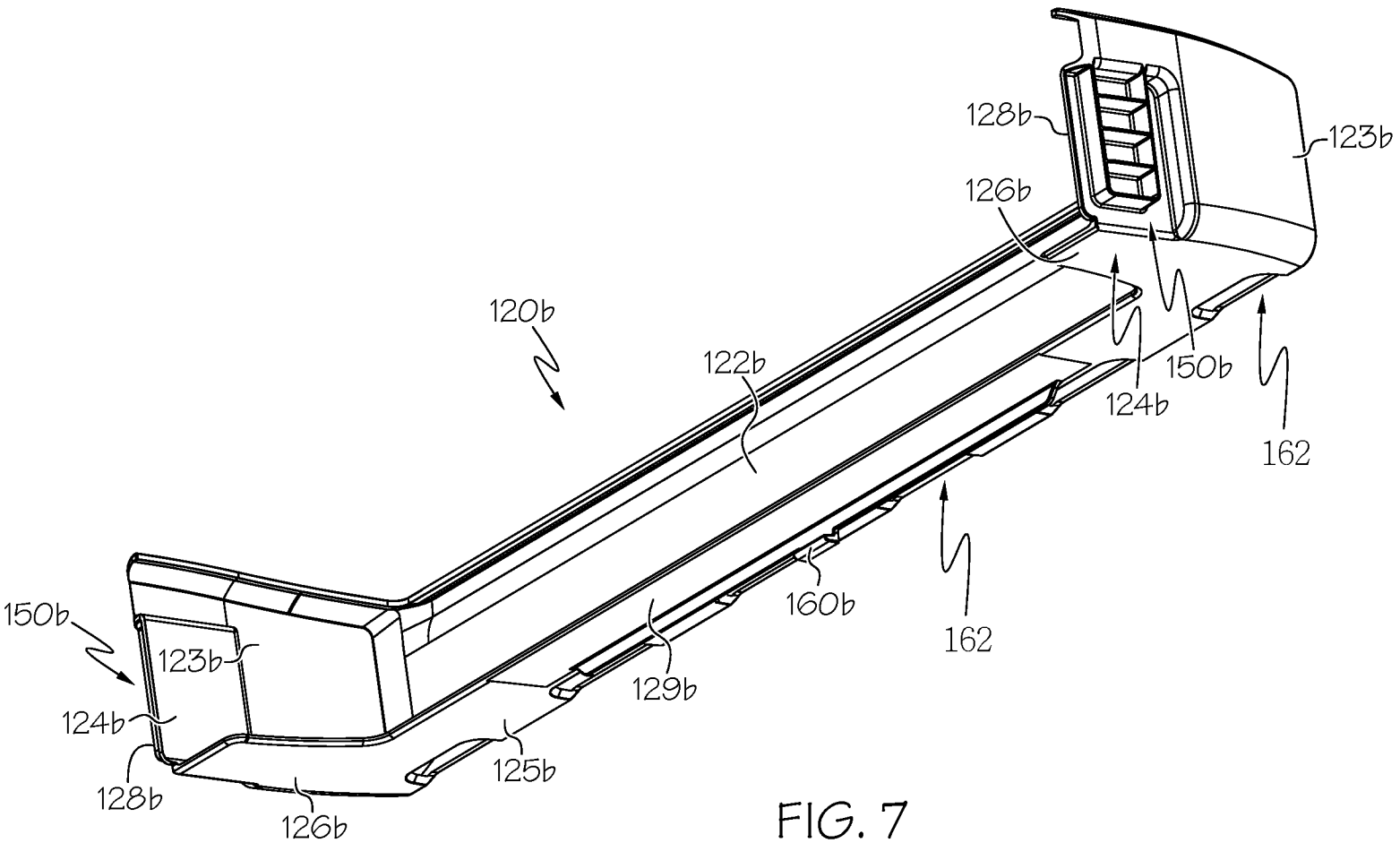
FIG. 7 is lower, perspective rear view of the door bin of FIG. 6.

Turning to FIGS. 6-7, one example storage bin 120*b* is shown in detail. The storage bin 120*b* includes a front wall 122*b*, side walls 123*b*, a bottom front wall 125*b*, and bottom side walls 126*b*. Defined between the bottom front wall 125*b* and the bottom side walls 126*b* is an open portion 127*b*, which is discussed in greater detail below. As can be seen in FIG. 7, the underside of the bottom front wall 125*b* includes a recessed portion 129*b*. Also extending from the underside of the bottom front walls 125*b* is a hook 160*b*. The side walls 123*b* include recessed portions 124*b* which contain storage bin lug assemblies 150*b*, discussed in greater detail below. Optionally, the storage bin 120*b* can have one or more through holes 162 to encourage airflow over items stored by the storage bin and/or within the refrigerator compartment generally.

Figure 8:
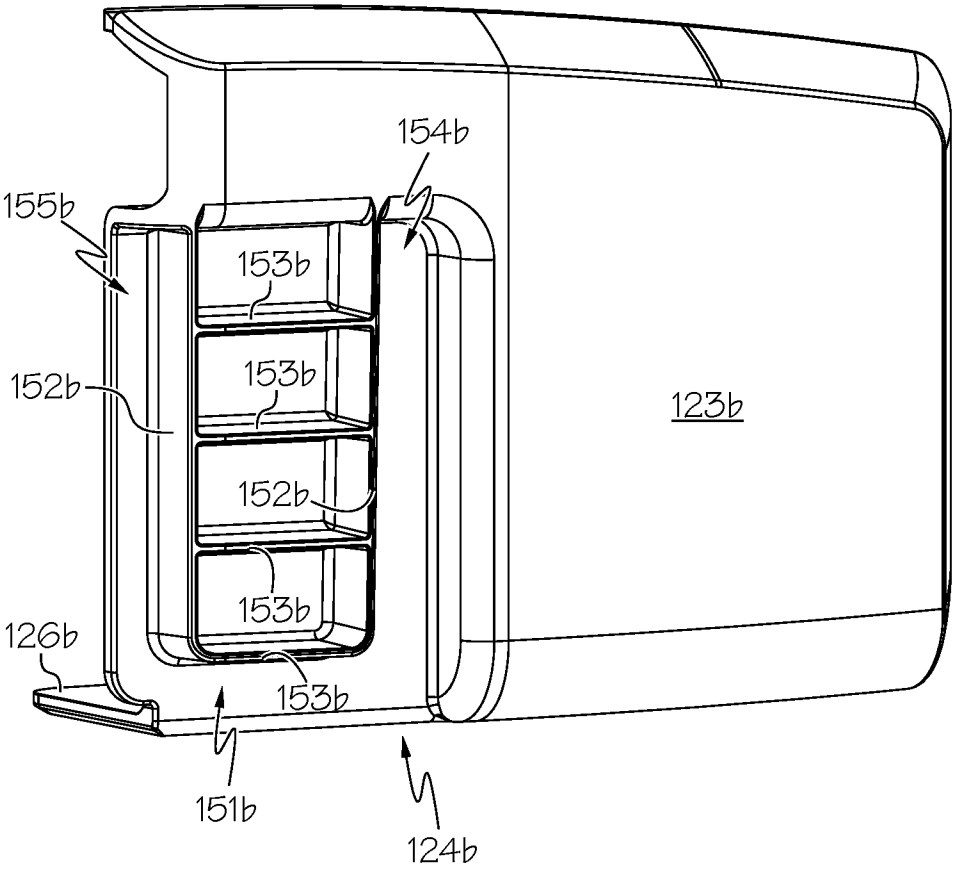
FIG. 8 is an enlarged detail view of the door bin lug assembly of the door bin of FIG. 6.

Turning to FIG. 8, one of the recessed portions 124*b* containing a storage bin lug assembly 150*b* is shown in detail. The lug assembly 150*b* includes a lug 151*b* defined by two vertical walls 152*b* and a number of horizontal walls 153*b* extending therebetween. In the recessed portion 124*b* between the right vertical wall 152*b* and the non-recessed portion of the side wall 123*b* is a side receiving portion 154*b*, discussed in greater detail below. On the left side of the left vertical wall 152*b* adjacent the rear edge 128*b* of the recessed portion 124*b* is a corner receiving portion 155*b*, discussed in greater detail below.

To mount the storage bin 120*b* to the liner 110, the bin 120*b* is inserted toward the rear wall 111*b*. Then, the storage bin 120*b* is moved downwards and lowered towards ledge 130*b* such that the vertical walls 152*b* of the storage bin lug assembly 150*b* are inserted into the side wall receiving space 144*b* of the liner 110 (i.e., preferably the vertical walls 152*b* abut or are immediately adjacent to the side wall lug 141*b* and the corner lug 142*b*), while the rear edge 128*b* of the recessed portion 124*b* is inserted into the rear wall receiving space 145*b* (i.e., preferably the rear edge 128*b* abuts or is immediately adjacent to the corner lug 142*b* and the rear wall lug 143*b*). Similarly, in an opposite manner, the side wall lug 141*b* of the liner 110 is inserted into the side receiving portion 154*b* of the storage bin lug assembly 150*b*, while the corner lug 142*b* of the liner 110 is inserted into the corner receiving portion 155*b*. Thereafter, the hook 160*b* on the bottom front wall 125*b* of the storage bin can be flexed to be snap-received within the receiving slot 134*b* on the front edge 133*b* of the ledge 130*b*. The bottom front wall 125*b* and the bottom side walls 126*b* rest on the recessed surface portion 132*b* of the ledge 130*b*. The raised surface portion 131*b* is received within the open portion 127*b* of the storage bin. Additionally, it is appreciated that either or both of the side wall lug 141*b* and rear wall lug 143*b* can have a ramped or cam-shaped structure to facilitate one-way snap-in installation of the storage bin onto the door liner. For example, as shown in FIG. 5, both of the side wall lug 141*b* and rear wall lug 143*b* can have a triangular-shaped geometry with the highest point (i.e., most extended point relative to the door liner) being located immediately adjacent to their respective receiving spaces 144*b*, 145*b* so as to readily enable insertion of the door bin, while also thereafter inhibiting removal of the door bin.

All of the above connections serve to secure the storage bin 120*b* to the liner 110. Specifically, the hook 160*b* being received within the receiving slot 134*b* secures the storage bin 120*b* in the vertical direction such that it cannot be lifted upwards without first flexing the hook 160*b* out of the slot 134*b*. The storage bin lug 151*b* being received within the side wall receiving portion 144*b* secures the storage bin 120*b* in the horizontal direction such that it cannot be drawn forward without first lifting the storage bin upwards such that lug 151*b* clears the side wall lug 141*b* and is not in the receiving portion 144*b*. The rear edge 128*b* of the storage bin 120*b* being received within the rear wall receiving space 145*b* prevents heavy items placed within the storage space 121*b* to cause the storage bin 120*b* to flex and/or buckle as a result of the weight such that the lug 151*b* could be raised out of the receiving portion 144*b*. Specifically, if a heavy item was placed in the center of the storage space 121*b*, its weight could cause the storage bin 120*b* to bend inwardly in a U-shaped manner whereby the side walls 123*b* are forced to move towards each other. This bend could result in the side walls 123*b* of the storage bin 120*b* to raise upwards such that the lugs 151*b* are raised out of the receiving space 144*b*. With the lugs 151*b* no longer secured within the receiving space 144*b*, weight on the front of the storage bin 120*b* could cause the storage bin 120*b* to fall forwards, resulting in the stored items falling. When the rear edge 128*b* of the storage bin 120*b* is received within the receiving space 145*b* of the door liner, the storage bin 120*b* is prevented from buckling or otherwise flexing inwardly. Specifically, if weight that would cause the storage bin 120*b* to bend in the U-shaped manner discussed above is applied, the rear edge 128*b* is slightly moved such that it abuts against both the corner lug 142*b* and the rear wall lug 143*b*. When abutting these lugs 142*b*, 143*b*, the rear edge 128*b*, and thus the storage bin 120*b*, can no longer buckle (i.e., the side walls 123*b* being forced to move towards each other) to the extent that the lugs 151*b* will become removed from the receiving space 144*b*.

Figure 9:
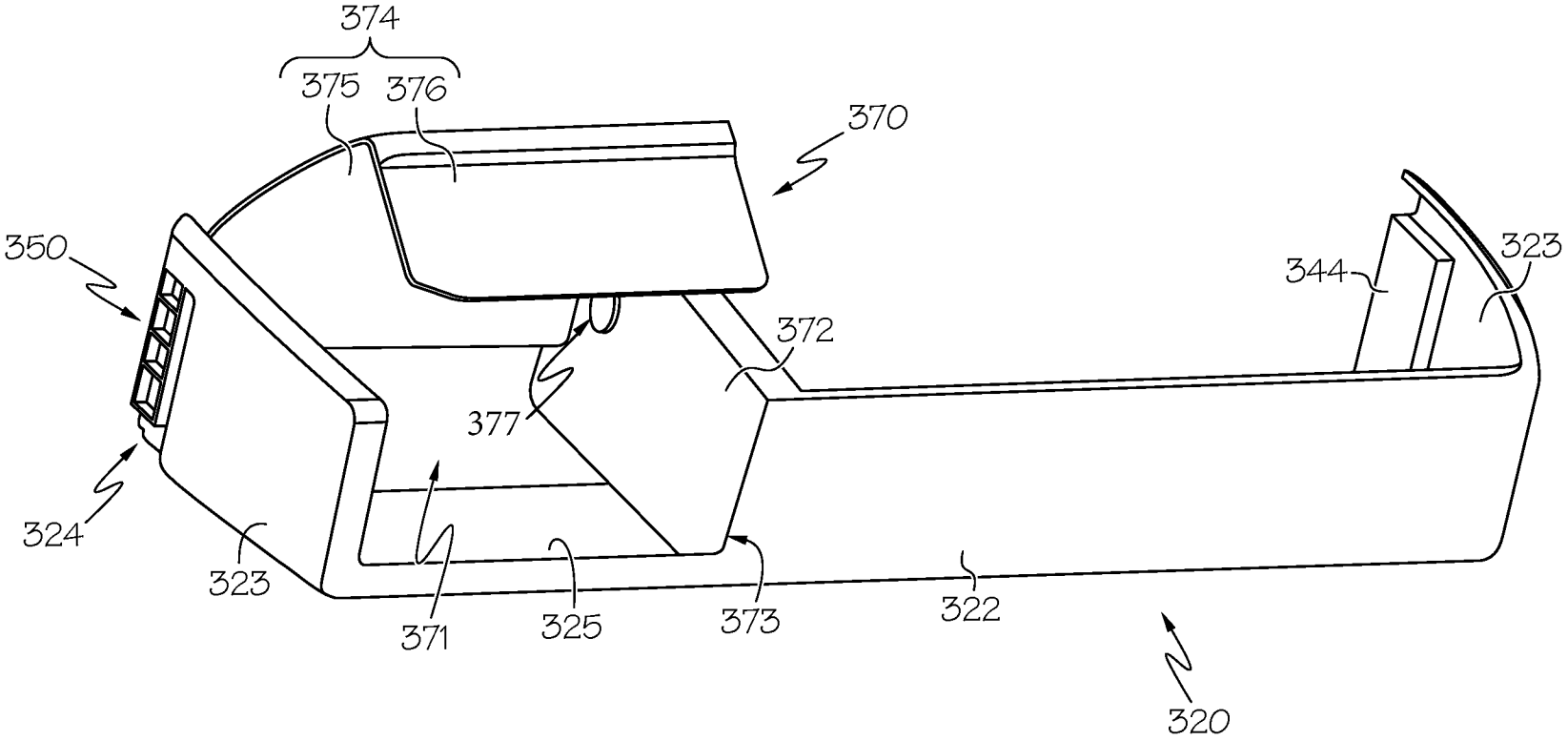
FIG. 9 is a front view of another example door bin having an isolated storage space according to another embodiment.

FIG. 9 shows a storage bin 320 according to an alternative embodiment. The storage bin 320 includes a front wall 322, side walls 323, a bottom front wall 325, and bottom side walls (not shown) similar to those of the storage bin 120. The side walls 323 include recessed portions 324 which contain storage bin lug assemblies 350 similar to those of the storage bin 120. At the assembled state, the storage bin 320 defines a main storage space 121*b*, and the storage bin 320 further comprises an isolated sub-section 370 defining an isolated storage space 371 for storing an item that is preferably isolated from the rest of the storage space of the storage bin, such as butter. In this regard, the isolated sub-section 370 can be thought of as a separate dairy bin or the like. The isolated storage space 371 is defined between one of the side walls 323 and a middle wall 372 extending rearwardly from the front wall 322 of the storage bin 320. It is to be appreciated that the middle wall 372 separates the isolated storage space 371 from the rest of the storage space of the storage bin 320. Although the isolated storage space 371 is illustrated towards the left side in FIG. 9, it is to be appreciated that this location is not intended to be limiting. In alternative embodiments, the isolated storage space 371 could be located towards the right side or towards the middle. Indeed, multiple isolated storage spaces 371 could be provided at various locations by the use of multiple middle walls 372. The front wall 322 of the storage bin 320 includes an open section 373 for allowing access to the isolated storage space 371. The open section 373 thereby allows access to the isolated storage space 371 from the front or top of the storage bin 320. The storage space is closable via a rotatable lid 374 which is rotatably attached to the side wall 323 and middle wall 372 by suitable pivot structure, such as pintles 377 or the like and corresponding receiving structure formed into any of the walls 323, 372 and the sides of the rotatable lid 374 (or vice-versa). The lid 374 includes a top wall 375 and a front wall 376. When closed (not shown), the top wall 375 extending between the top portions of the side wall 323 and middle wall 372, whereas the front wall 376 closes the open section 373 of the front wall 322, thereby isolating the isolated storage space 371 from the surrounding environment and inhibiting airflow exchange between the isolated storage space 371 and the remainder of the cooled compartment. It is to be appreciated that a rear wall of the fresh food door liner 210 forms the rear wall of the storage space when the storage bin 320 is mounted to the liner 210, and that the ledge may form part of the bottom wall of the isolated storage space 371. In other examples, integrally-formed bottom and rear walls can be provided for the isolated storage space 371 so that it forms a completely closed environment. Similarly, the storage bin 320 could be mounted to the freezer door liner 110, if desirable, to define a soft freeze zone or the like. It is to be appreciated that the storage bin 320 also includes other features present in the storage bin 120*b* shown in FIGS. 6-8 that are not illustrated in FIG. 9 for simplicity.

Figure 9B:
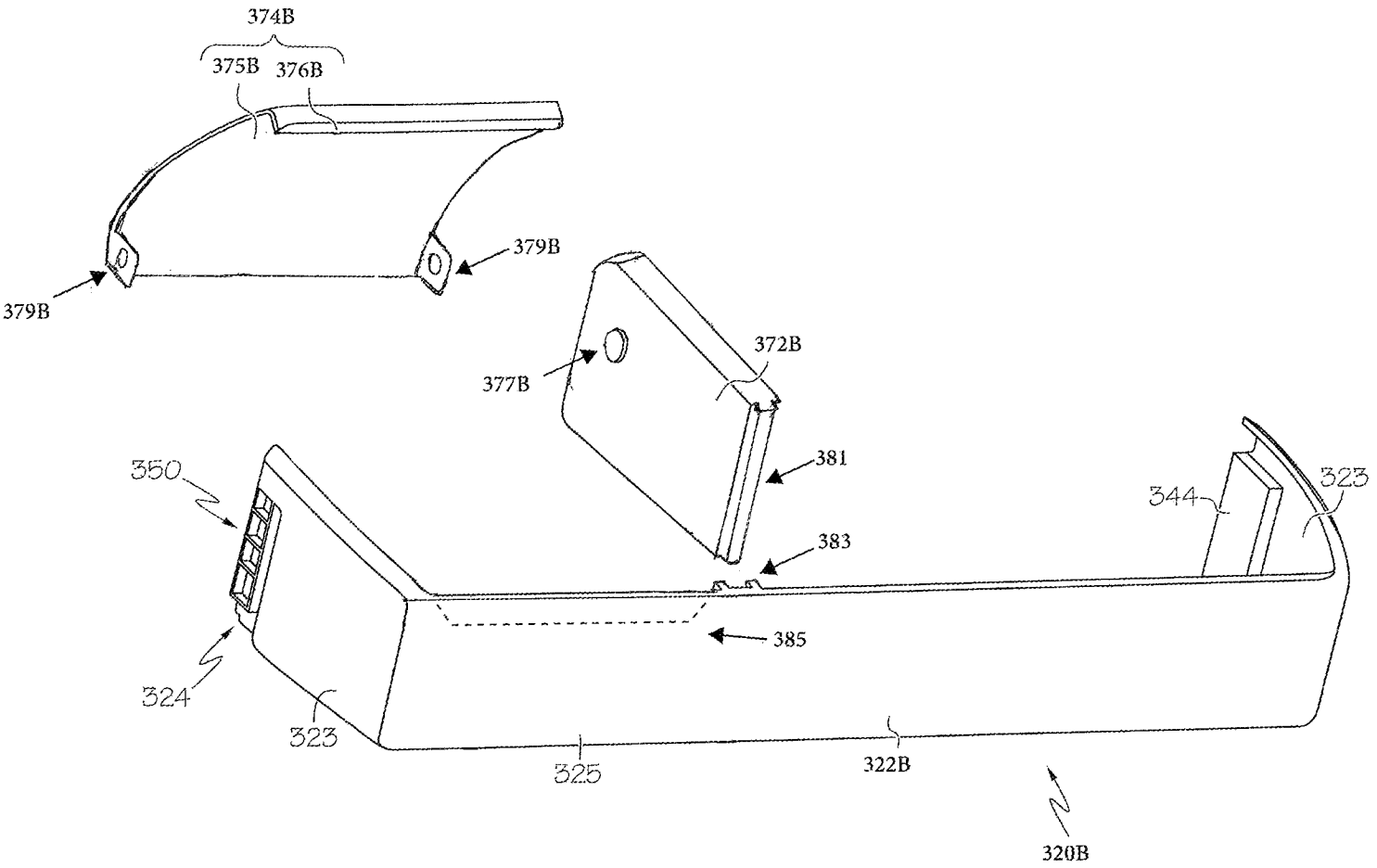
FIG. 9B is a front view of yet another example door bin having another embodiment of an isolated storage space.

Turning now to FIG. 9B, yet another example storage bin 320B is illustrated having an isolated storage space 371B according to another embodiment. It is to be appreciated that the storage bin 320B also includes other features present in the storage bin 120*b* shown in FIGS. 6-8, and features present in FIG. 9, which may not be shown for simplicity. Additionally, as compared with FIG. 9, the same features in FIG. 9B are illustrated with a "B" identifier.

In the embodiment shown in FIG. 9B, the storage bin 320B can be provided as a single base unit that is configured to optionally accept a removable middle wall 372B to thereby enable the selective addition of an isolated storage space 371B (or optionally, multiple spaces). For example, the removable middle wall 372B and the front wall 322B could each include corresponding connection structure that enables the middle wall 372B to be removeably secured to the front wall 322B. In the shown example, the middle wall 372B includes a linear projecting tongue 381 that is configured to be received within a corresponding linear slot 383 or groove located on and extending at least partially along, including completely along, the inner surface of the front wall 322B. Optionally a groove or other alignment structure can be provided in a bottom interior wall of the storage bin 320B to capture a corresponding bottom of the middle wall 372B. Various other male/female connection structure can be used, preferably without additional fasteners (although such fasteners could optionally be used to increase connection strength). As before, the middle wall 372B can include a pintle 377B that is snap-fit into corresponding receiving structure (such as a pivot hole 379B) formed into the lid 374B.

Optionally, the upper surface of the front wall 322B could include a notched or recessed section 385 that generally aligns with and corresponds to the geometry of the front of the lid 374B, such as the top and/or front wall(s) 374B, 376B to allow a user to readily grab and lift the lid 374B. In further optional embodiments, the notched or recessed section 385 could be removable when it is desired to add the isolated storage space 371B. Although the isolated storage space 371B is illustrated towards the left side in FIG. 9B, it is to be appreciated that this location is not intended to be limiting. In alternative embodiments, the isolated storage space 371B could be located towards the right side or towards the middle, or multiple isolated storage spaces could be provided at various locations by the use of multiple removable middle walls 372B. Multiple slots 383 could be provided on the front wall 322B to permit the isolated storage space 371B to be positioned at different locations (right, center, left) or can even permit multiple such storage spaces to be provided. In yet another optional embodiment, providing multiple slots 383 upon the front wall 322B could enable a user to select a preferred width of the isolated storage space 371B by selecting a desired width of lid 374B from among different sizes, and then inserting the removeable middle wall 372B into an appropriate slot 383.

The invention has been described with reference to the example embodiments described above. Modifications and alterations will occur to others upon a reading and understanding of this specification. Example embodiments incorporating one or more aspects of the invention are intended to include all such modifications and alterations insofar as they come within the scope of the appended claims and their equivalents.

What is claimed is:

1. A refrigeration appliance comprising:

a cabinet comprising a compartment within the cabinet for storing food items in a refrigerated environment;

a refrigeration system for providing a cooling effect within the compartment;

a door rotatably secured to the cabinet to provide selective access to said compartment, said door comprising:

an external wall, a door liner attached to the external wall and having a first side configured to face the compartment, the door liner comprising at least two side walls protruding outwards from the first side towards the compartment and a ledge protruding from the first side of the door liner towards the compartment, the ledge positioned between, and oriented perpendicular to, said at least two side walls, and a storage bin mounted to the door liner, the storage bin comprising at least two side walls and a front wall;

wherein the side and front walls of the storage bin, the ledge, and walls of the liner define a storage space of the storage bin, wherein the at least two side walls of the door liner each comprise a plurality of lugs defining an open receiving space therebetween, and the side walls of the storage bin each having a projecting lug, and wherein at an assembled state when the storage bin is mounted to the door liner, said projecting lugs of the storage bin side walls are received within the receiving spaces on the side walls of the door liner, wherein the lugs of the side walls of the door liner comprise a side wall lug projected inwards from an inner face of the side walls and a corner lug projected inwards at a corner where the inner face of the side wall meets a rear wall of the door liner, wherein each said projecting lug of the storage bin side walls is flexible in a direction towards the lugs of the door liner when received in the receiving space therebetween such that each said projecting lug of the storage bin is resiliently secured between the lugs of the door liner, wherein the rear wall of the door liner further comprises a rear-wall lug adjacent each said corner lug defining a rear receiving space therebetween, wherein a rear edge of the side walls of the storage bin is received within the rear receiving space defined between each said rear-wall lug and each said corner lug when the storage bin is mounted to the door liner, and wherein the rear edge of the side walls extends in a linear, rearward direction from the projecting lug.

2. The refrigeration appliance of claim 1, wherein the ledge forms a portion of a bottom surface defining the storage space.

3. The refrigeration appliance of claim 2, wherein a bottom wall of the storage bin forms part of the bottom surface.

4. The refrigeration appliance of claim 3, wherein the ledge has a main surface and a recessed portion offset from the main surface, and wherein the bottom wall rests on the recessed portion so that the bottom wall is substantially flush with the main surface of the ledge.

5. The refrigeration appliance of claim 4, wherein the bottom wall has an open portion that receives a raised surface portion of the ledge.

6. The refrigeration appliance of claim 1, wherein each said projecting lug of the storage bin side walls comprises two vertically-extending walls projected outwardly and a plurality of horizontally-extending supports connecting the vertically-extending walls.

7. The refrigeration appliance of claim 1, wherein each said projecting lug of the side walls of the storage bin is positioned within a recessed portion of the side walls.

8. The refrigeration appliance of claim 7, wherein each said projecting lug defines, within the recessed portion, a first receiving space for receiving the side wall lugs and a second receiving space for receiving the corner lugs.

9. The refrigeration appliance of claim 1, wherein the storage space defines a main storage space, and the storage bin further comprises an isolated sub-section defining an isolated storage space separate from said main storage space.

10. The refrigeration appliance of claim 9, wherein the isolated sub-section comprises a rotatable lid that selectively opens and closes said isolated storage space.

11. The refrigeration appliance of claim 10, wherein an upper surface of the front wall of the storage bin comprises a notched or recessed section that generally aligns with and corresponds to a geometry of a front of the lid.

12. The refrigeration appliance of claim 9, wherein the isolated storage space is at least partially defined by a middle wall that separates the isolated sub-section from said main storage space.

13. The refrigeration appliance of claim 12, wherein the middle wall is removably secured to the front wall of the storage bin.

14. The refrigeration appliance of claim 13, wherein the middle wall includes a linear projecting tongue that is configured to be received within a corresponding linear slot located on and extending at least partially along an inner surface of the front wall of the storage bin.

15. The refrigeration appliance of claim 12, wherein middle wall comprises pivotable structure that rotatably connects to a rotatable lid that selectively opens and closes said isolated storage space.

16. A refrigeration appliance comprising:

a cabinet comprising a compartment within the cabinet for storing food items in a refrigerated environment;

a refrigeration system for providing a cooling effect within the compartment;

a door rotatably secured to the cabinet to provide selective access to said compartment, said door comprising:

an external wall, a door liner attached to the external wall and having a first side configured to face the compartment, the door liner comprising at least two side walls protruding outwards from the first side towards the compartment and a ledge protruding from the first side of the door liner towards the compartment, the ledge positioned between, and oriented perpendicular to, said at least two side walls, and a storage bin mounted to the door liner, the storage bin comprising at least two side walls and a front wall;

wherein the side and front walls of the storage bin, the ledge, and walls of the liner define a storage space of the storage bin, wherein the at least two side walls of the door liner each comprise a plurality of lugs defining an open receiving space therebetween, and the side walls of the storage bin each having a projecting lug, and wherein at an assembled state when the storage bin is mounted to the door liner, said projection lugs of the storage bin side walls are received within the receiving spaces on the side walls of the door liner, the storage bin further comprising a hook extending outwards from a lower side of a bottom front wall thereof, and the ledge of the door liner further comprising a receiving space, wherein the hook is lockingly received within the receiving space when the storage bin is mounted to the door liner.

* * * * *